United States Patent [19]

Hoffmann

[11] Patent Number: 4,714,515

[45] Date of Patent: Dec. 22, 1987

[54] STRAIGHT LINE CONTAINER LABELING APPARATUS

[75] Inventor: Wolfgang W. Hoffmann, Modesto, Calif.

[73] Assignee: Shibuya America Corporation, Modesto, Calif.

[21] Appl. No.: 910,024

[22] Filed: Sep. 22, 1986

[51] Int. Cl.[4] ..... B65C 3/12; B65C 9/04; B65C 9/34

[52] U.S. Cl. ..... 156/450; 156/455; 156/458; 156/521; 156/568; 156/DIG. 11; 156/DIG. 26; 156/DIG. 41

[58] Field of Search ..... 156/450, 455, 521, 568, 156/DIG. 26, DIG. 41, DIG. 11, DIG. 13, 458, 542

[56] References Cited

U.S. PATENT DOCUMENTS

| | | | |
|---|---|---|---|
| 3,607,568 | 9/1971 | Laub, III | 156/455 |
| 3,783,077 | 1/1974 | Messmer | 156/455 |
| 3,928,115 | 12/1975 | Kerwin | 156/DIG. 26 |
| 4,314,869 | 2/1982 | Crankshaw | 156/DIG. 41 |

*Primary Examiner*—Michael Wityshyn
*Attorney, Agent, or Firm*—Melvin R. Stidham

[57] ABSTRACT

Cylindrical containers are rolled between two parallel belts which travel in opposite directions and engage diametrically opposite sides of the containers. One of the belts carries labels under the rolling containers so that the label is wrapped around it. The other belt moves at a somewhat greater velocity so that the container moves slowly downstream as they roll rapidly about their own axes. From the labeling belt, the drive belt continues to move the containers over a roll-on pad on which the label is pressed firmly in place.

6 Claims, 2 Drawing Figures

STRAIGHT LINE CONTAINER LABELING APPARATUS

BACKGROUND OF THE INVENTION

Machines for the high speed application of labels to cylindrical containers generally include a label transport drum and a container feed turret rotating in opposite directions so that the containers are brought into tangential relationship with the label transport drum where gummed labels are transferred to the containers. While such machines have performed well, centrifugal forces generated by the rotating container turrets have imposed limitations on the rate of production. Other machines, such as that shown in my U.S. Pat. No. 4,500,386, granted Feb. 19, 1985 for "Container Feed For Labeling Machine" requires that the containers change their path of travel as they pass adjacent to the label transfer drum.

OBJECTS OF THE INVENTION

It is an object of this invention to provide a container feed for a labeling machine wherein the containers travel a straight line through the labeling process.

It is a further object of this invention to provide a labeling machine that is easily adjusted for different container sizes.

It is a further object of this invention to provide a labeling machine wherein containers are rolled rapidly about their own axes over gummed labels so that a label is wrapped around a container in a relatively short length of container travel.

Other objects and advantages of this invention will become apparent from the description to follow, particularly when read in conjunction with the accompanying drawing.

SUMMARY OF THE INVENTION

In the apparatus of this invention, a drive belt engages the cylindrical sides of containers to move them downstream. At the same time, a labeling belt, which travels toward the upstream end of the machine engages the diametrically opposite sides of the containers and carries gummed labels to apply them to the sides of the containers. The oppositely moving belts cause the containers to roll rapidly around their own axes and, because the drive belt is moving faster, the containers move downstream. As each container rolls over a gummed label the label is wrapped quickly around the container. Thereafter, each container is moved off of the labeling belt and across a roll-on pad where each label is pressed firmly in place.

DESCRIPTION OF A PREFERRED EMBODIMENT

Figure 1:
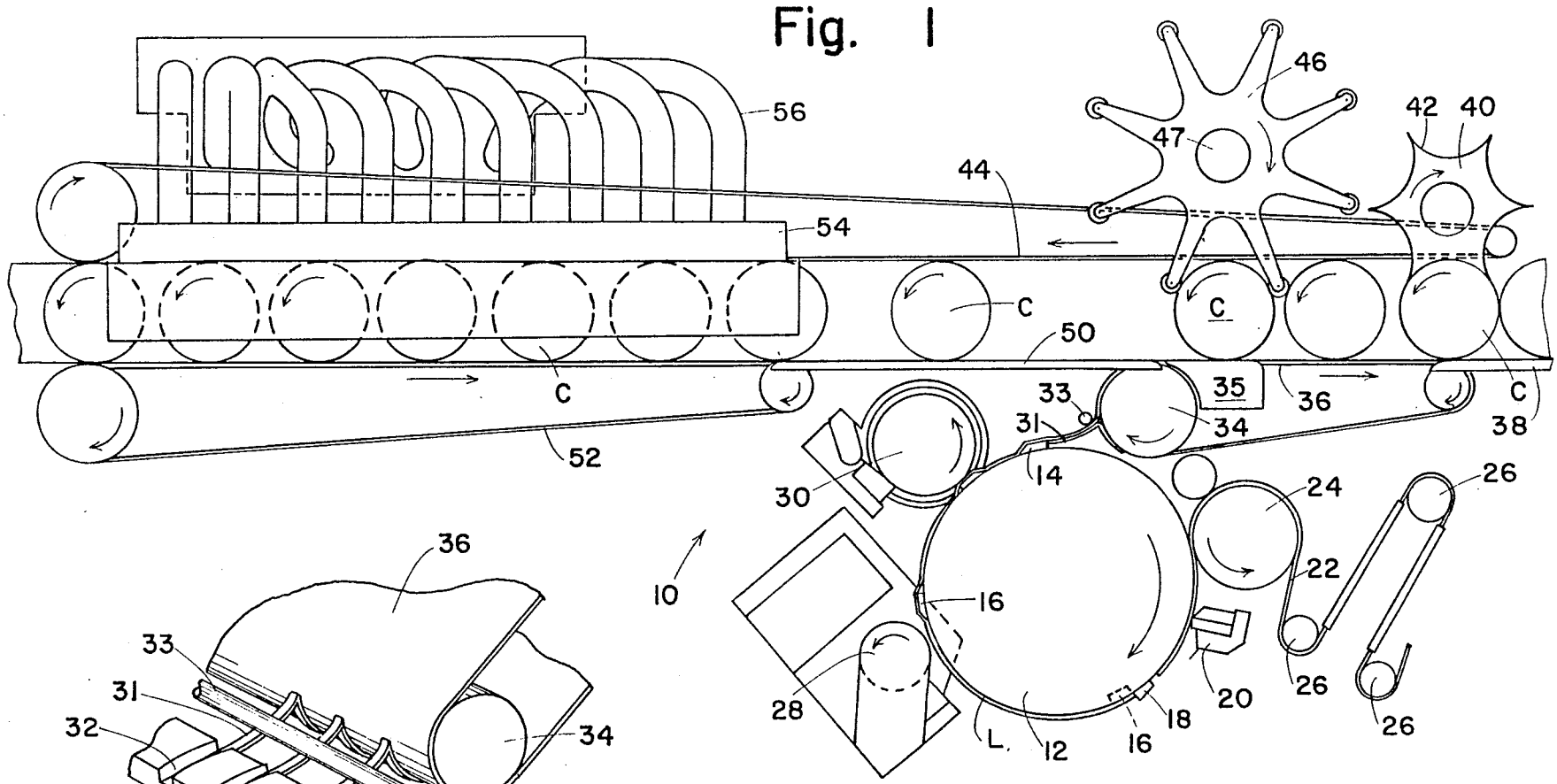
FIG. 1 is a plan view of labeling apparatus arranged in accordance with this invention.
Figure 2:
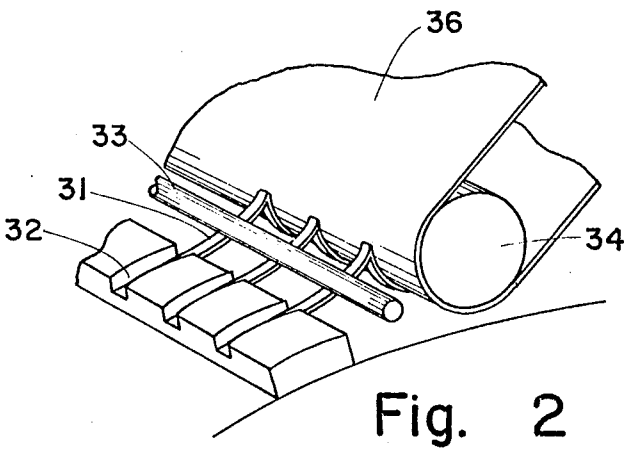
FIG. 2 is a partial view in perspective of the label transferring mechanism.

Referring now to the drawing with greater particularity, the labeling apparatus 10 of this invention includes a label severing and transporting drum 12 of the type shown in co-pending U.S. application Ser. No. 06/785,074 filed Oct. 7, 1985 for "Apparatus For Applying Labels To Containers, now U.S. Pat. No. 4,632,721." The label transport drum 12 includes radially extendable vacuum pads 14 and 16 for the leading and trailing edges, respectively, of a label L. A cutting knife 18 carried directly on the drum just behind each trailing edge gripping pad 16, severs the trailing edge of each label as it passes the stationary cutter 20. Each vacuum pad 14 and 16 is retracted as it passes the stationary cutter 20 to avoid interference therewith.

A continuous strip of label stock 22 is fed by a feed roller 24 over tension rollers 26 and onto the drum 12 where its leading edge is gripped by the vacuum pad 14 and pulled, with both vacuum pads in retracted position, until the cutting knife 18 moves past the stationary cutter 20 to sever a label L. The leading edge vacuum pad 14 is held retracted until it passes a solvent applicator 28. Then, the leading edge vacuum pad is extended for application of a hot melt adhesive at the glue roller 30. Where the same glue is to be applied to the trailing edge, the vacuum pad 16 is also extended as it approaches and passes the glue roller 30. However, in the event that a plastic label is to be applied to a container C, the trailing edge vacuum pad 16 is extended, as shown, as it passes the solvent applicator 28, where a solvent of the plastic material is applied to form a tacky solution at the trailing edge of the label L. After the trailing edge of the label L passes the solvent applicator 28, the trailing edge gripping pad is retracted.

In any event, whether glue or solvent is applied to the trailing edge, each gummed label L is stripped down from the transport drum 12 by fingers 31 engaging in slots 32 in the vacuum pad 14. The labels L are fed by a high speed roller 33 to a vacuum wheel 34, over which is entrained a porous labeling belt 36 that carries each label to the right, as indicated by the arrow. As the porous belt 36 passes over the vacuum wheel 34 and a vacuum plate 35 the label L is pressed to the belt, so that the label L is carried positively, without slippage, along with the belt.

In the meantime, the containers C are delivered from the right by a conveyor 38 to a timing star 40 having recesses or pockets 42 thereon that momentarily grip each container C, and then release it in timed relationship to the label feed belt 36. The containers are driven to the left by a main drive belt 44, which is driven at a slightly greater velocity than that of the labeling belt 36 moving in the opposite direction. The net effect is to cause the containers to rotate rapidly about their own axes in a counterclockwise direction, while traveling at relatively low speed toward the left. Just before a container C reaches the leading edge of a gummed label L it is engaged by a second star wheel 46 having rollers on the ends of the arms that engage and align each container while allowing it to rotate freely between the belts 36 and 44. The star wheel 46 aligns each container C with the star wheel axis 47, so that the container is perpendicular with the labeling belt 36. When the gummed leading edge of a label is applied to the container, the rolling container C simply wraps the label L around itself. Then, when the container C leaves the labeling belt 36, it continues to roll along a roll-on pad 50 that adds extra pressure to the label L to ensure that its overlapped edges are firmly bonded together.

The containers may continue along the roll-on pad for the full length of the belt 44. In the alternative, and particularly where plastic labels are being applied, the containers C may move from the roll-on pad 50 to a secondary drive belt 52 that causes them to spin on their own axes while the slightly faster main drive belt 44 carries them slowly through a shrink tunnel 54, into which hot air is blown from ducts 56 to shrink the plastic label tightly around the container C. This application of heat also crystalizes the hot melt glue on the leading edge so that, when the container is emptied of its contents, the label can be easily torn from the container to facilitate recycling the container.

The labeling apparatus 10 of this invention is easily adjustable for different size containers. The main drive belt 44 and the star wheels 40 and 46 may be mounted for movement toward and away from the labeling belt 36 and the roll-on pad 50 to accommodate containers of a range of sizes.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. Labeling apparatus comprising:

a main drive belt moving in one linear direction;

a labeling belt moving in the opposite linear direction;

said belts being generally parallel and spaced to engage diametrically opposite sides of a generally cylindrical container so that a container therebetween is rotated thereby;

said drive belt moving at a greater speed than that of said labeling belt so that a container therebetween is moved slowly in the direction of movement of said drive belt;

means for delivering containers between said belts at the upstream end of said drive belt; and means for delivering gummed labels to the upstream end of said labeling belt.

2. The labeling apparatus defined by claim 1 including:

vacuum means for holding a label to said labeling belt until engaged by a container rolling thereon.

3. The labeling apparatus defined by claim 1 including:

means for delivering said containers between said belts in separated, time relation.

4. The labeling apparatus defined by claim 1 including:

a roll-on pad extending from the upstream end of said labeling belt.

5. The labeling apparatus defined by claim 1 including:

alignment star means engaging each container between said belts to align the axes thereof perpendicular to the direction of movement of said labeling belt.

6. The labeling apparatus defined by claim 5 wherein said alignment star means comprises:

a wheel with a plurality of arms extending radially therefrom;

rollers rotatably mounted on the ends of said arms to engage containers between them while enabling rotation thereof.

* * * * *